United States Patent [19]

Soupios

[11] 4,240,319

[45] Dec. 23, 1980

[54] ELECTRIC GUITARS

[76] Inventor: Charles C. Soupios, 69 Thomas Ave., Bethpage, N.Y. 11714

[21] Appl. No.: 12,791

[22] Filed: Feb. 16, 1979

[51] Int. Cl.[3] ..... G10D 1/08; G10D 3/06

[52] U.S. Cl. ..... 84/263; 84/267; 84/291; 84/293

[58] Field of Search ..... 84/263, 267, 291, 293

[56] References Cited

U.S. PATENT DOCUMENTS

| | | | |
|---|---|---|---|
| 550,529 | 11/1895 | Pyle | 84/291 |
| 832,157 | 10/1906 | Platts | 84/263 |
| 2,261,357 | 11/1941 | Fuller | 84/267 |
| 3,080,785 | 3/1963 | Evans | 84/267 |
| 3,130,625 | 4/1964 | Savona | 84/267 |
| 3,392,618 | 7/1968 | Pelensky | 84/267 |
| 3,783,731 | 1/1974 | Pash | 84/267 |
| 3,833,751 | 9/1974 | Chapman | 84/327 |

FOREIGN PATENT DOCUMENTS

| | | | |
|---|---|---|---|
| 2312766 | 9/1974 | Fed. Rep. of Germany | 84/291 |
| 1057730 | 10/1953 | France | 84/263 |
| 689931 | 4/1965 | Italy | 84/293 |
| 67338 | 1/1944 | Norway | 84/267 |

*Primary Examiner*—J. V. Truhe
*Assistant Examiner*—Shelley Wade
*Attorney, Agent, or Firm*—Fidelman, Wolffe & Waldron

[57] ABSTRACT

A double neck string instrument in the nature of an electric guitar adapted for two voice play with one neck extending parallel to the other neck spaced apart therefrom, offset longitudinally thereof, and offset from the plane of the stringed face thereof, so that each hand can play on a different neck without play of one hand on one neck interfering with the play of the other hand on the other neck. Each neck has its own sound pick up.

11 Claims, 6 Drawing Figures

ELECTRIC GUITARS

INTRODUCTION

This invention relates to a multiple neck string instrument intended for two voice play. In a preferred embodiment of this invention a modified full-bodied electric guitar is combined with a stick-form guitar having its own sound pick up to form a two neck string instrument capable of two voice play.

BACKGROUND OF THE INVENTION

The usual string instrument such as a guitar, mandolin, banjo, is basically a one voice play instrument. While one hand plays on the individual strings, the other hand, i.e. the left hand, controls the acoustic range of the instrument by varying effective string length. These instruments therefore exhibit limited musical capabilities, compared for example to a keyboard instrument, such as the piano.

Workers in the music instrument art have appreciated the desirability of enhancing the musical capability of string instruments, and over the years have made various suggestions bearing on the rationale of this invention.

One such suggestion has been to mount two necks on the base of a stringed instrument. Each neck is provided with a bank of strings, the two banks of strings are played alternatively, not together. The player shifts both hands from one playing neck to the other (see for example U.S. Pat. No. 2,222,959).

A variation on the provision of multiple, alternatively played necks integral with the instrument as a whole, is provision of a support member corresponding to the sounding board base portion of a guitar and a multiplicity of stringed neck assemblies alternatively attachable to the support member. (See for example U.S. Pat. No. 3,538,807).

In terms of the objective of this invention to provide a two voice string instrument, expedients such as alternatively played multiple neck string instruments or alternative removable necks for (a single neck) string instrument can be criticized for their failure to consider the very possibility of two voice play.

The advent of electronic amplification has allowed the art to dispense with the sounding board feature of string instruments through electronic amplification of the sound made by the strings. By and large the art has not also fully appreciated that electronic amplification will permit the playing hand to employ a tapping or drumming mode of play, and while doing so, also control the pitch according to where on the strings the playing hand taps; the player may tap appropriately along the length of a fretted neck. In total the electric guitar is capable of one hand play, leaving the other hand free to play a second electric quitar device at the same time, creating thereby a two voice instrument.

The concept of a two voice play construction in a stringed instrument has been suggested by the art. (See for example U.S. Pat. No. 3,742,114). However so far as is known to the inventor herein any electric guitar string instruments intended for two voice play have, heretofore, been ill-adapted to such purposes.

Significant to the genesis of this invention is that electric guitars do not require (for acoustic purposes) an enlarged base. Stick-like stringed instruments have, in fact, been suggested to the art (see for example U.S. Pat. No. 3,833,751).

RATIONALE OF THIS INVENTION

On consideration of the possibilities for electrical amplification of the musical notes produced from the strings of a string instrument, and for transformation of the electric signal through synthesis, the inventor herein appreciated that the neck of an electric guitar instrument can be played adequately by one hand alone, leaving the other hand free to play adequately on a second string instrument, achieving thereby true two voice play.

Manifestly, many geometric requirements are imposed upon any string instrument intended for two voice play. Each hand must be able to play independently without interfering with play by the other hand. The bank of strings for left hand play should be convenient to the left hand. At the same time, the bank of strings for right hand play should be convenient to the right hand.

Transformation of these geometric requirements into an actual preferred mode instrument for two voice play was carried out in the belief that acceptance of the two voice string instrument of this invention by the music world would be facilitated through employment therein of construction details that mask the very basic change in the nature of the string instrument one voice to two a voice form of play.

Thus an effort has been made to employ such assemblies, structural components, and electrical accessories, etc. well known in the art to build the two voice play string instruments of this invention. In construction of a preferred embodiment of this invention modifications to sub-assemblies, component elements, etc. already known and used in the art necessary for practice of this invention were made with an eye toward avoiding creation of a sense of strangeness. However, significant modification and much repositioning of both elements and assemblies relative to prior art string instrument practice is intrinsic to practice of this invention.

BRIEF DESCRIPTION OF THE INVENTION

A preferred mode of this invention may briefly be described as a two neck electric guitar, the second neck being a removable stick-form guitar with its own sound pick up means, and the first neck being part of what by itself resembles a standard full-bodied electric guitar.

The (stick-form guitar) second neck extends from the pick guard base portion of the apparently standard electric guitar parallel to the first neck thereof (i.e. the first neck) spaced apart therefrom, offset longitudinally therefrom and offset also from the plane of the strings on the first neck.

BRIEF DISCUSSION OF THE INVENTION

More generally, the two voice play stringed musical instrument of this invention comprises a base member from which extend two parallel spaced apart stringed necks. The two necks are offset one from the other longitudinally. Through this longitudinal offset, the neck for left hand play extends past the end of the neck for right hand play.

The planes of the necks, particularly the planes at the playing faces of the necks, e.g. the fret boards and/or the strings on each neck, already specified as parallel but spaced apart are laterally offset too. Thus, the neck for right hand play is disposed below and in front of the neck for left hand play. (The geometric relationship of the two playing necks can be seen in FIG. 1 of the hereinafter described drawing.)

The left hand is free to move longitudinally of the rear neck the entire length of the bank of strings thereon. The right hand is free to move longitudinally of the forward neck the entire length of the bank of strings thereon with movement of each hand being without interference from independent movement of the other hand, because in the mode described herein, the right hand play neck is beneath and in front of the left hand play neck. The left hand reaches up from beneath the first neck to play thereon; the right hand passes in front of both necks and plays on the second neck with a downward direction play.

Normally the bank of strings on the two playing necks are strung in a different key. Desirably, usual electric guitar string groupings will be present, as for example the grouping for a bass guitar on one neck, and a like set of strings one octave higher on the other neck with sequence of strings on both necks. An independent sound pick up means is provided on each neck although, both sound pick ups may well feed into the same amplifier. If desired, one or both sound pick up means may feed into a synthesizer.

In addition to the already indicated preference to construct preferred modes of this invention from (commercially) available components and sub-assemblies so as to mask the basic shift in the nature of the string instrument, a comparable approach can be taken with regard to the basic shift from one voice play to two voice play. Such a shift for musicians already trained in one voice play string instruments toward two voice play is facilitated by constructing one stringed neck as a stick-form accessory attachable to the pick guard of an otherwise independent full-bodied electric guitar. The base portion or pick guard of the full-bodied electric guitar is, of course, modified to receive the stick-form accessory, but nonetheless the full-bodied electric guitar moiety can be used by itself. The assembled two neck instrument as a whole is recognizable by a guitar player as something playable. The musician may gradually gain facility in two voice play, particularly when the accessory neck is constructed and strung only for a precussive mode of play.

DETAILED DESCRIPTION OF THE INVENTION

For a more complete understanding of this invention the details of construction of a preferred mode of the invention will be provided below in terms of a preferred exemplary embodiment of the invention, such preferred embodiment being an electric guitar modified to mount thereon (detachably) a stick-form guitar accessory.

For the description which follows, reference is made to the attached drawing wherein.

Figure 1:
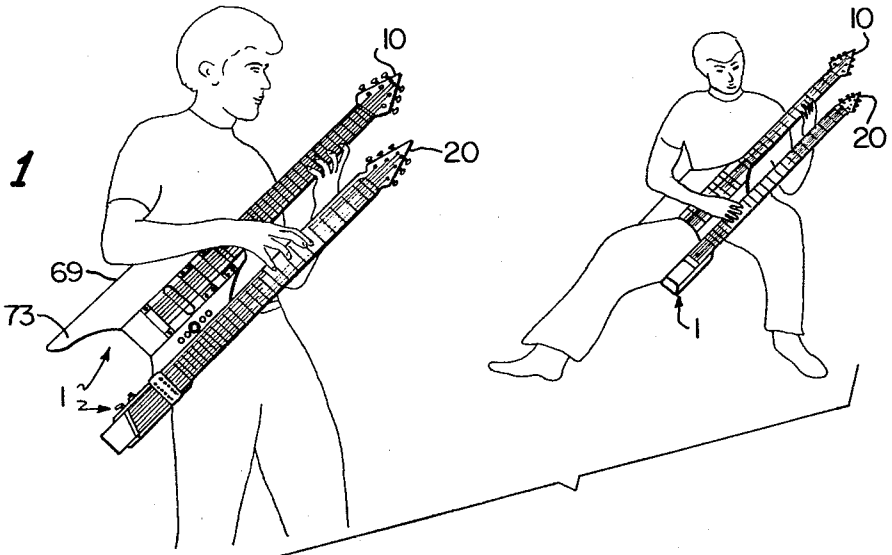
FIG. 1 shows a performer playing a preferred embodiment of this invention in both standing and seated positions.
Figure 2:
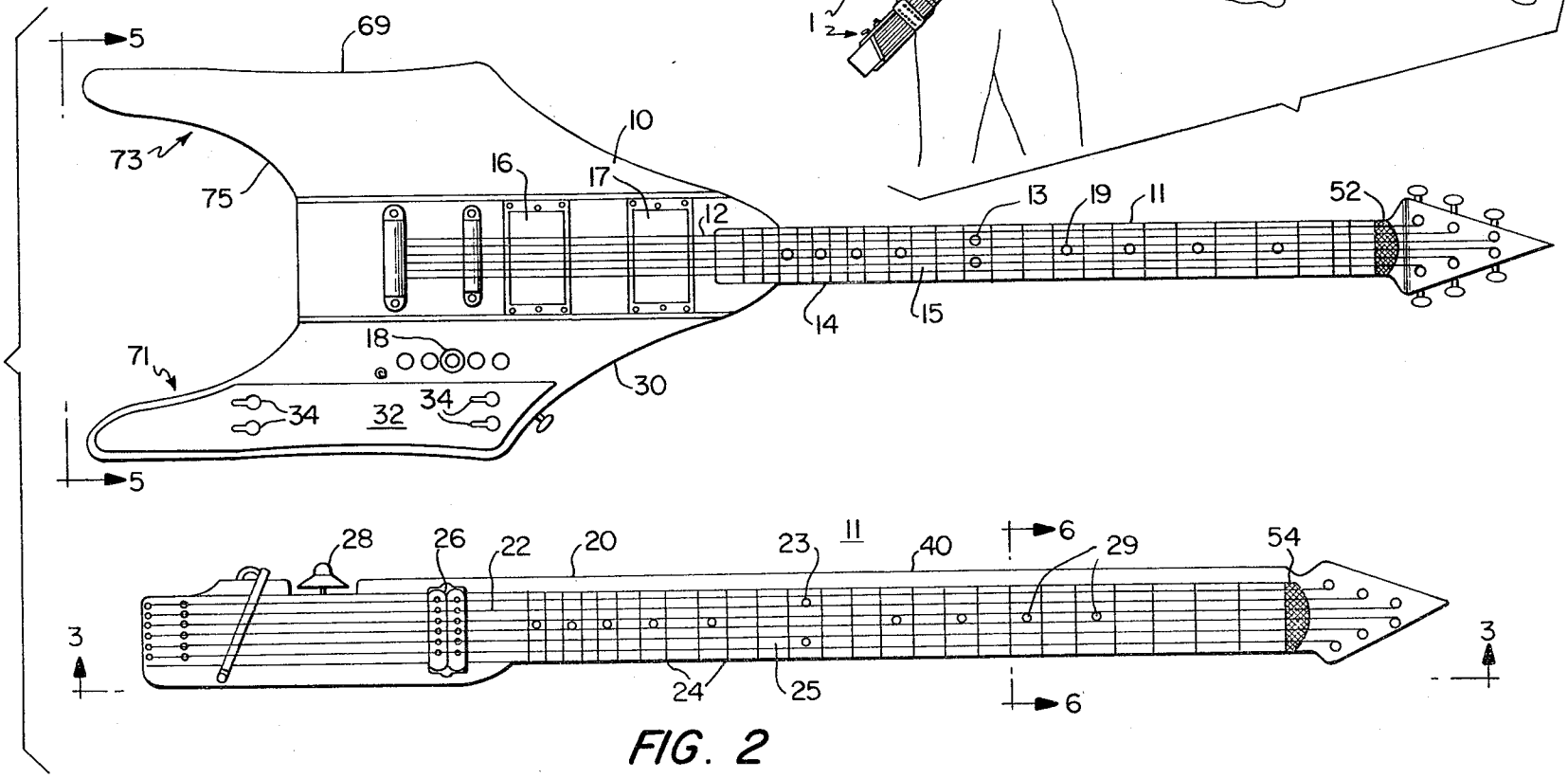
FIG. 2 is a plan view illustrating as separate components the modified electric guitar and the stick-form electric guitar.

Referring now to the drawing and in particular to FIGS. 1 and 2, it may be noted that the two voice instrument 1 of the present invention involves a pair of independent electrical guitars 10 and 20. One electric guitar 10, is a full-bodied guitar with a playing neck 11 the other electric guitar 20 is a stick-like or stick-form electric guitar. Individually, many details of construction in each guitar may be conventional, as for example each guitar herein illustrated is provided with a bank of six strings 12 and 22, strung over a set of frets 14 and 24 on touch boards 15 and 25 respectively, with twenty four frets being illustrated for guitar 10, and twenty five frets being illustrated for guitar 20. Each guitar has its own sound pick-up means two, 16 and 17 having been provided on full-bodied guitar 10, and a single pick-up means 26 having been provided on stick-form guitar 20. Each guitar has its own tone and volume control system, 18 and 28 respectively and appropriate electrical connections 31, 33, 35, 37, for the output signals.

Thus guitars 10 and 20 may be played independently (by different musicians, for example). In the practice of the invention, however, they are intended to be joined together as a single two voice instrument and are strung appropriately. Thus guitar 20 may be strung an octave longer than guitar 10, and both guitars should be fitted with an effective string vibration damping means (to avoid sympathetic vibration). Felt pads 52 and 54 are the damping means. The different string length in the embodiment illustrated herein may make desirable stringing the longer fret board of guitar 20 a whole step lower then the strings for guitar 10, and of course the fret markings 19 and 29 are appropriate to each guitar.

The term "Ax" commonly refers to the electric guitar and for convenience will be used thereafter. Guitar 10 will be referred to as the first Ax and guitar 20 as the second Ax, the two together as in the assembled instrument being identifiable herein by the arbitrary term "bi-Ax".

Figure 3:
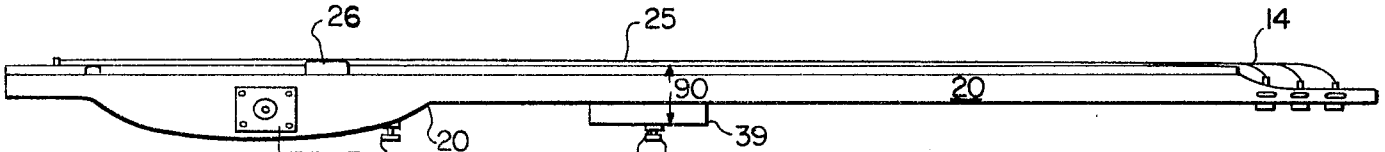
FIG. 3 is a side view of the stick form guitar taken along line 3—3 of FIG. 2.
Figure 4:
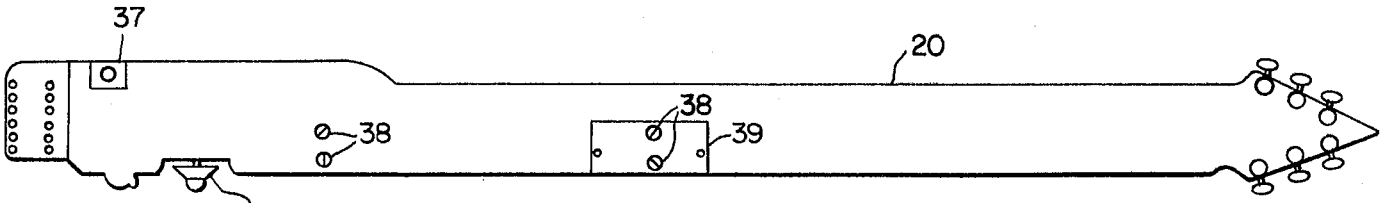
FIG. 4 is a plan view of the underside of the stick form guitar.

When the "bi-Ax" is assembled, the first and second Ax are removably attached together through the keyhole and pin arrangement illustrated in FIGS. 2, 3, 4. On guitar 10, the first Ax, is affixed a plate 32 adjacent the peripheral edge of the pick guard region 30. For convenience, the pick guard region is hereafter referred to as the guitar base 30. Plate 32 upstands from the surface of the guitar base 30 sufficiently to allow for presence of a set of keyhole apertures 34 in plate 32. A set of matching pins 36 (see FIGS. 3 and 4) which depend from spacing plate 39 or directly from the underside of stick-form guitar 20, fit snuggly into keyhole slots 34 and lock the first and second Ax together. A flat wide head 38 present on pin 36 together with close dimensioning between pins 36 and keyhole slots 34 prevent any relative movement of the first and second Ax, except of course in the locking and unlocking direction axially of the keyhole slots.

As can be seen in FIG. 1 the normal playing positions of the instrument is at an angle that cause the force of gravity, i.e. the weight of guitar 20, to hold guitar 20 down against the narrow base end of the keyhole slots 34, i.e. the locking direction. Thus in two handed play of the instrument the two neck string instrument of this invention constitutes an integral unit despite the detachability of the second Ax from the first Ax.

As can be seen in FIG. 1, the desired offset between the planes of the strings and fret boards of guitars 10, 20 is created by the depth of guitar 20 i.e. dimension 90 on FIG. 3 and the extent to which plate 32 upstands from the surface of base 30.

Mention has already been made that the first Ax, i.e. guitar 10, may be a full-bodied guitar capable of being played by itself, alone and separate from the second Ax. However, guitar 10 is not a standard guitar. Significant modifications are present in the illustrated mode of guitar 10 as adaptations for the two voice play of the "bi-Ax". Specifically, the guitar neck 11 extends non-symetrically of base member 30 from a mid-portion thereof. The portion of base 30 below neck 11, i.e. the lower leg 71 portion on which plate 32 has been mounted is wider than the portion of the base above neck 11 i.e. the upper leg 73 portion. No structural reason for symmetry exists. However, for appearance sake, the upper leg portion of base 30 is made close enough to the lower leg portion, e.g. same length, and not quite same width as the lower portion of base 30, so that the absence of symmetry is not readily apparent to the eye, and above all, is not disturbing to the player of the instrument (particularly significant when the first Ax is to be played alone). The width dimension built into the lower portion of the base 30 determines how far apart the two necks will be spaced and the spacing desired is usually more than a standard full-bodied guitar will provide. The spacing between neck 11 of the first Ax and the stick-like guitar of the second Ax illustrated in the drawing, is enough for the players' left hand to clear the top longitudinal edge of the second Ax when reaching in to play on neck 11 of the first Ax. Desirably the clearance between the bottom edge of neck 11 and the adjacent top edge of stick form guitar 20 will be in the range of 2.5 to 5 inches.

The upper leg portion 73 of base number 30 is not entirely cosmetic. As shown in FIG. 1, the right arm of the player passes in close proximity to the upper side edge of base member 30 and might even rest thereon. Accordingly this edge may be contoured for arm rest purposes. In the illustrated mode the upper edge 69 has been rounded off for arm support purposes.

The bifurcated structure of guitar base 30 of a lower leg 71, upper leg 73, and the U-shaped bottom edge 75 is functional. The "bi-Ax" can be played from a set down position as is generally illustrated in figure. Then the inner edge of upper leg portion 73 rests on the right thigh of the player (appropriate indentation and rounding off at the edge being provided). The lower outer edge of base 30 rests on the left thigh of the player. Desirably the stick-form guitar of the second Ax is not part of the sit-down play support structure.

Figure 5:
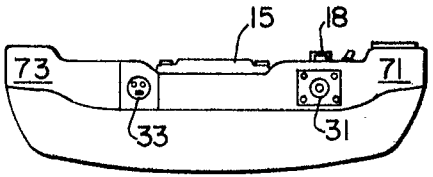
FIG. 5 is an end view taken along lines 5—5 of FIG. 2.

Other modifications vis a vis standard electric guitar structures are present in guitar 10. Specifically, the fret board surface of neck 11 and the extension thereof below the top surface of base 30 is depressed below the surface of the base as can be seen in FIG. 5 (about $\frac{1}{4}$'-'-$\frac{3}{8}$"). The reason for depressing the center piece region is to protect the strings of the first Ax from contact by (the shirt or jacket of) the player's right hand when the player reaches over the first Ax to play on the second Ax. Depressing the center piece portion of full-bodied electric guitar 10 as has been illustrated in FIGS. 1 and 5 facilitates the clearances desired in the "bi-Ax".

Allusion has already been made as to how plate 32 is secured to the face of base 30 and is upstanding therefrom. In consequence, the planar fret board face on the stick-form quitar 20 is offset vertically from the planar fret board face of the playing neck 11 the electric guitar 10, somewhat more than the dimension 90 indicated on FIG. 3. The total offset is about $1\frac{3}{4}$"–$3\frac{1}{2}$". This vertical offset together with the longitudinal, and lateral spacing between the two playing necks is sufficient to allow one hand of the player e.g. the left hand to move longitudinally along neck 11 of the first Ax without encountering interference due to presence of the second Ax, i.e. guitar 20. The relationships are generally illustrated in FIG. 1. At the same time the three-dimensional offsets, longitudinal, lateral and vertical are sufficient for the other hand of the player, e.g. the right hand, to clear the first Ax while playing upon the second Ax.

The longitudinal displacement of the head end of the second Ax from the head end of the first Ax may for example be 4" to 10". Since ease of play and comfort of the player are quite important, the more significant spacing is perhaps the distance between the key spot 13 on guitar 10 and key spot 23 on guitar 20, a distance of about 12" having been provided in the mode illustrated.

Figure 6:
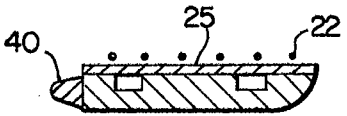
FIG. 6 is a side section of the stick form guitar taken along line 6—6 of FIG. 2.

Just as the structure of full-bodied guitar 10 is intentionally a minimally modified (single voice) guitar, so too is the structure of stick-form guitar 20 minimally different from the stick-form guitars of the prior art. The principal modification is provision of a thumb rest ridge 40 which extends along on the upper side edge of the guitar. The player's thumb may rest on ridge 40. In consequence, guitar 20 is not longitudinally symmetrical. The touch board of fret board 25 is offset, so to speak, towards the bottom edge second Ax as may be seen from the cross section view of FIG. 6. Metal reinforcements may be advisable for stick-form guitar 20, as for example flat rods 41.

It has been recognized by the art that the strings on multiple neck guitars require damping to prevent the strings of one neck from vibrating sympathetically while the other guitar neck is played generating thereby unwanted tones. Muting and damping means have been suggested. An occurance of like sympathetic vibrations is possible with the two voice string instrument of the present invention. In order to avoid such vibrations damping elements are included in the touch board of both guitars. A felt damping strip 52 is present on neck 11 adjacent the head piece of the neck and a felt damping strip 54 is present on stick-form guitar 20 adjacent the head piece end.

Play of the "bi-Ax" is related to but different from the most common ways to play a guitar. Strumming, finger picking double picking, rest strokes, thumb strokes, etc. all require a right hand technique to initiate string action. (The reverse is true with left hand guitars). While the right hand creates the sound furnishing the attack or beginning of each note, the left hand establishes the pitch desired from each string.

There is, however, a rarely used method of play called the "hammer-on" wherein the left hand creates both the attack and the pitch. Hammer-on involves tapping the strings percussively against the fingerboard. The locale along the frets receiving the string pressure determines pitch. A firm, quick hammer-like tapping serves to create the attack and to determine pitch. The hammer-on method of play is rarely used because such left hand alone attach produces only 50%–60% of the volume achieved by the right hand working together with the left hand. Indeed the construction of some quitars e.g. rounded necks, make hammer-on difficult. A rectangular neck and large frets as is herein contemplated and light guage strings with thin cores improve the quality of hammer on play. The first Ax may be provided with a more sensitive sound pick up and/or greater amplification than is usual in electric guitars to equalize volume, if equal volume is wanted.

Left hand hammer-on mode of play on the first Ax leaves the right hand free for an independent hammer-on type of play on the second Ax. Thus true two voice play is possible with the two neck instrument of this invention.

Play by the two hands independently on different necks should be more than merely employment of the hammer-on technique independently by each hand. The position of the left hand reaching up from beneath the necks is not completely natural (to the way of thinking of the inventor herein) and care must be taken to properly strike the correct strings when forming chords. The right hand is above its playing neck and uses a downward direction of play, a more natural motion, with the downward percussion being capable of a stronger attack than upward percussion. Accordingly, a stronger melody line can be achieved with the right hand, and softer background chords can be achieved with the left. The left hand can for example play a steady base line. Desirably each Ax has its own independant volume control so that the musician can compensate, as desired, to the relative volume produced left hand and right hand, and of course to the musical qualities desired from each voice.

A skilled musician can play keyboard music on the "bi-Ax" with little or no rearrangement. Hopefully, skilled musicians will take full advantage of the musical capabilities of the "bi-Ax".

The two voice stringed instrument of this invention has been described in terms of attaching together a minimally modified full-bodied electric guitar and a stick-form guitar into a mode that facilitates play of the two voice instrument by persons already familiar with the electric guitar. However, other modes of the invention are possible and some are expressly contemplated. The instrument of this invention may be formed from two stick-form electric guitars together with a separate base member adapted to position the playing necks in the already described spatial relationship. A suitable separate base member may be, for example, a double holster structure, or else be a plate shaped (in crosssection) like a pair of steps connected by an angled or vertical web and containing on each step attachment means such as keyhole slot structure described above, one for each Ax. To repeat, the crucial aspects of this invention are the spatial relationships within the "bi-Ax". In all else considerable variations are possible. Thus the sound pick ups may feed into the same amplifier circuit, or into different amplifier circuits. A synthesizer may be connected to either or both playing necks.

What is claimed is:

1. A multiple neck stringed musical instrument in the nature of an electric guitar adapted for two-voice play comprising a base member and a first and second stringed neck extending therefrom, said second neck extending from the base member parallel to the first neck, spaced apart therefrom, and offset laterally and longitudinally thereof whereby the played upon face of said second neck is positioned relative to the played upon face on said first neck for simultaneous independent play on each neck.

2. The musical instrument of claim 1 wherein both necks are removably secured to said base member.

3. The musical instrument of claim 1 wherein said second neck is removably secured to said base member and wherein said first neck and said base member are integral one with the other.

4. A multiple neck stringed musical instrument in the nature of an electric guitar adapted for simultaneous two-voice play comprising a base member and two necks extending therefrom, a first neck extending from a mid-portion of said base member the second neck extending from adjacent one side edge of said base member parallel to said first neck, spaced apart therefrom and offset laterally and longitudinally thereof, whereby the played upon face of said second neck is positioned relative to the played upon face on said first neck for simultaneous independent play on each neck.

5. The musical instrument of claim 4 including means for detachably securing said second neck to the base adjacent one side edge thereof.

6. The musical instrument of claim 1 including a bifurcated bottom end on said base member, adapted to straddle one thigh of a seated player resting at least in part thereon.

7. The musical instrument of claim 6 wherein the bifurcated bottom of said base member includes an upper leg and a lower leg, the upper leg being contoured on one side edge thereof for seating against one thigh of a seated player, the said aforementioned second neck extending longitudinally over the top surface of said lower leg of said base member.

8. The musical instrument of claim 4 wherein the base member is asymetric relative to the mid-portion thereof from which said first neck extends, the one side portion including the side edge region from which said second neck extends being wider than the opposing side portion of said base member.

9. The musical instrument of claim 3 wherein the base member has thereon a mid-portion depression below the top surface of the base member, and wherein the strings of said first neck extend over the base member at said midportion depression.

10. An accessory for a single neck electric guitar having a generally planar base member and a single stringed guitar neck extending from a mid-portion of said base member generally coplanar with said base member, said accessory comprising a stick-form electric guitar adapted for attachment to the top surface of a said base member adjacent one edge of said base member to extend parallel to the guitar neck spaced apart therefrom, offset longitudinally thereof and offset laterally from the played upon face of the guitar neck, said accessory having a sound pick-up means thereon.

11. The accessory of claim 9 including a thumb rest ridge at one longitudinal edge thereon.

* * * * *